US007589707B2

(12) United States Patent
Chou

(10) Patent No.: US 7,589,707 B2
(45) Date of Patent: Sep. 15, 2009

(54) ACTIVE MATRIX LIGHT EMITTING DEVICE DISPLAY PIXEL CIRCUIT AND DRIVE METHOD

(76) Inventor: Chen-Jean Chou, 21 Ridgefield Rd., New City, NY (US) 10956

( * ) Notice: Subject to any disclaimer, the term of this patent is extended or adjusted under 35 U.S.C. 154(b) by 480 days.

(21) Appl. No.: 11/162,826

(22) Filed: Sep. 24, 2005

(65) Prior Publication Data

US 2006/0066527 A1 Mar. 30, 2006

Related U.S. Application Data

(60) Provisional application No. 60/522,396, filed on Sep. 24, 2004.

(51) Int. Cl.
*G09G 3/36* (2006.01)

(52) U.S. Cl. ..... 345/92; 345/76; 345/82; 345/214

(58) Field of Classification Search ..... 345/81–83, 345/87, 92–93, 76, 67; 315/169.1, 169.3, 315/169.4
See application file for complete search history.

(56) References Cited

U.S. PATENT DOCUMENTS 5,408,109 A 4/1995 Heeger et al. ..... 257/40
5,482,896 A 1/1996 Tang ..... 438/28
5,663,573 A 9/1997 Epsteinet et al. ..... 257/40
5,684,365 A 11/1997 Tang et al. ..... 315/169
5,952,789 A 9/1999 Stewart et al. ..... 315/169
6,157,356 A 12/2000 Troutman ..... 345/28
6,501,466 B1 12/2002 Yamagishi et al. ..... 345/28
6,580,408 B1 6/2003 Bae et al. ..... 345/76
6,618,030 B2 9/2003 Kane et al. ..... 345/82
6,621,100 B2 9/2003 Epsteinet et al. ..... 257/40
6,686,699 B2 2/2004 Yumoto ..... 315/169
6,734,636 B2 5/2005 Sanford et al. ..... 315/169
7,053,875 B2 * 5/2006 Chou ..... 345/92
7,388,564 B2 * 6/2008 Yumoto ..... 345/82
2005/0083270 A1 * 4/2005 Miyazawa ..... 345/76
2006/0186832 A1 * 8/2006 Osame et al. ..... 315/292

* cited by examiner

*Primary Examiner*—Amare Mengistu
*Assistant Examiner*—Hong Zhou

(57) ABSTRACT

Display pixel circuits and a drive scheme utilizing a switching element operating in reverse direction in a data scan period to provide voltage reference are provided. Preferred embodiments and operation method leading to three-transistor solutions in current-control mode, common-cathode, and n-channel transistor drive configuration for light emitting device display are described.

30 Claims, 15 Drawing Sheets

100

ACTIVE MATRIX LIGHT EMITTING DEVICE DISPLAY PIXEL CIRCUIT AND DRIVE METHOD

CROSS REFERENCE

The present application is claiming the priority of U.S. Provisional Patent Application No. 60/522,396, filed on Sep. 24, 2004.

BACKGROUND OF THE INVENTION

1. Field of the Invention

The present invention relates to the pixel circuit of active matrix displays and a drive scheme to operate the displays comprising such pixel circuits. Pixel circuits and a method are provided to set a data in a pixel and to deliver a drive current to the pixel according to said data setting.

Furthermore, the present invention relates to the pixel circuits and drive method of an active matrix display, where the pixel circuits comprise active elements, such as thin film transistors, for controlling the light emitting operation of the respective light emitting devices in a pixel. More specifically, the present invention provides structures of pixel circuit that combines a data setting circuit formed between a data electrode and a scan electrode, and a voltage referencing circuit that provides a reference voltage to a storage device in the pixel during a data setting period without having to keep the storage element to adhere to the same reference voltage in other periods of operation.

Furthermore, preferred embodiments of pixel circuits comprising alternating conducting channels, controlled by a multi-functional control electrode are provided. Pixel circuits capable of performing current-controlled drive scheme for active matrix light emitting device display, with reduced complexity than existing solutions, are provided as preferred application of the present invention.

2. Description of the Prior Art

Organic light emitting diode displays (OLED) have attracted significant interests in commercial application in recent years. Its excellent form factor, fast response time, lighter weight, low operating voltage, and prints-like image quality make it the ideal display devices for a wide range of application from cell phone screen to large screen TV. Passive OLED displays, with relatively low resolution, have already been integrated into commercial cell phone products. Next generation devices with higher resolution and higher performance using active matrix OLEDs are being developed. Initial introduction of active matrix OLED displays have been seen in such products as digital camera and small portable video devices. Demonstration of OLED displays in large size screens further propels the development of a commercially viable active matrix OLED technology. The major challenges in achieving such a commercialization include (1) improving the material and device operating life, and (2) reducing device variation across the display area. Several methods have been suggested to address the second issue by including more active switching devices in individual pixels, by switching of power supply lines externally, or by reading back the pixel parameters combined with an external memory and tuning circuit. As more elaborated control circuits being incorporated into individual pixels as proposed in these solutions, concerns over complexity and practical manufacturing issues arise.

The operation of an OLED display differs from a liquid crystal display (LCD) in that each and every pixel in an OLED display comprises a light emitting element. The light output of such light emitting elements is more conveniently controlled by the current directed to the pixel. In contrast, an LCD is readily operable by voltage signals as its optical response being more favorably expressed in a simple form of applied voltage. While typical storage devices hold information in the form of voltage, operating an active matrix OLED display via a typical storage element requires a conversion mechanism within a pixel to convert a stored voltage data into specific current output. In practice, a conversion method needs to be reliable and fairly independent of such factors as pixel-to-pixel variation in the characteristics that affect said conversion, to make an OLED display operable with fair uniformity.

Basic examples of using organic material to form an LED are found in U.S. Pat. Nos. 5,482,896, 5,408,109 and 5,663,573, and examples of using organic light emitting diode to form active matrix display devices are found in U.S. Pat. Nos. 5,684,365 and 6,157,356, all of which are hereby incorporated by reference.

An active matrix OLED display (FIG. 1) is typically structured with "SELECT" electrodes for row select, "DATA" electrodes for setting the pixel state, power electrodes VDD to drive the pixels, and a reference voltage VREF to provide a common voltage level. A basic pixel in an active matrix display also comprises at least one transistor for data control, and at least a storage element to hold the data information sufficiently long so a pixel remains stable in a data state in an image frame. A circuit diagram for a basic pixel 100 in an active matrix OLED display is depicted in FIG. 2 in further detail. An active matrix display with pixel circuit structured as in FIG. 2 allows data to be written and retained in a storage capacitor 204 according to the data signal delivered from a data electrode in an address cycle, while the power supply VDD continuously drives OLED 205 through an n-channel transistor 201, according to the data setting in capacitor 204. The selection of pixels to receive data information is controlled by an n-channel transistor 203 that is controlled by the voltage on a select electrode connected to the gate of transistor 203. An active matrix driving scheme allows the drive transistor 201 remain in a data state, and continue to deliver the required drive current, for an extended period of time after the input data on the data electrode is disconnected from the pixel. The peak current required for achieving a certain brightness level is thus reduced accordingly compared to a passive matrix. The peak driving current in an active matrix display does not scale with the resolution as in a passive matrix, making it suitable for high resolution applications. Stability of the active matrix display is also improved appreciably.

As illustrated in the above example, the electrical current for producing light output is directed to the light emitting element via a current path that comprises at least a control element that regulates the current. In a conventional light emitting device display, these control elements are fabricated on a thin film of amorphous silicon on glass. Power consumed in such control elements are converted to heat rather than yielding any light. To reduce such power consumption, polycrystalline silicon is preferred over amorphous silicon for its better mobility. More elaborated methods employing self-regulated multiple-stage conversions suitable for pixel circuit using polysilicon base material may be found in U.S. Pat. Nos. 6,501,466 and 6,580,408. These methods provide a current drive scheme while largely eliminated the impact from material and transistor non-uniformity typically associated with thin film polysilicon on glass base plate. In these methods, typically a minimum of four transistors are required to achieve such self-regulated, multi-stage conversion to achieve a pixel-independent current drive for the light emitting device display. An example of such methods is illustrated in FIG. 3. where four transistors 301, 302, 303, and 307, and 3 access electrodes, DATA, SELECT, and VDD, are used for each pixel with a storage capacitor 304 and an OLED 305.

The circuit in FIG. 4 illustrates another method for a self-regulating current drive scheme. The display circuit includes a switch on a power supply electrode, switching the source voltage between two voltage levels VDD1 and VDD2. Comparing to the example of FIG. 3, the transistor count of FIG. 4 is less than that of FIG. 3, but an additional access electrode with switching capability is required to operate the pixel and to deliver drive current to the light emitting diode in a current drive scheme.

FIG. 5 illustrates another method that reads the pixel parameters into an external processing circuit that comprises memory and adjustment circuitry. The variations of pixel parameters, such as the threshold voltage variation, may be eliminated by such external adjustment. The pixel circuit comprises five transistors and five access electrodes.

These examples of prior art provide a brief overview of the existing solutions considered in the art to resolve the uniformity issue. Comparing to the basic pixel circuit in FIG. 2, it is evident that any current solution to the uniformity issue involves a substantial increase in the complexity of pixel circuit, and thus likelihood of reduction of available light emitting area, efficiency, and product yield.

The present invention provides a multi-functional scan electrode for pixel access that carries the conventional pixel select function and providing a conversion function for converting a data current to a data voltage. The present invention further provides multiple conducting channels in a pixel, for setting the data voltage and delivering drive current. The pixel structure so constructed comprises a direct current path from a data electrode to a scan electrode, and may further comprise a direct current path from a scan-power electrode to the light emitting element. The turning-on and off of such channels are fully controlled by the voltage applied on a scan-power electrode.

SUMMARY OF THE INVENTION

In an active matrix display, data information is delivered to the pixels of the display in a data setting period. Such data setting period for a pixel is controlled by applying a scan voltage to the scan electrode that turns on a gating circuit in the pixel to allow data information to enter said pixel. A conventional gating circuit is a gating transistor, such as transistor 203 illustrated in FIG. 2, which is turned on by a scan voltage on the select (scan) electrode, and wherein the scan electrode provides no further communication with the pixel beyond the gate of transistor 203.

The present invention provides a pixel circuit in an active matrix display with a data setting circuit connecting a data electrode and a scan electrode. Said data setting circuit conducts a data current directed from a data electrode to a scan electrode during a data setting period. Furthermore, said data setting circuit sets a storage element to a data voltage according to the data information. Furthermore, a voltage referencing circuit and method are provided to operate an active element, such as a transistor, in a data setting period in such a manner that one end of said storage element in the pixel is connected to a reference voltage via this active element that is configured in reverse direction of its configuration in other period of time. Such operation provides a fixed reference voltage to said storage element in a data setting period during which a data voltage is set to the storage element, while releasing the storage element from such voltage constraint in other period of operation.

Preferred embodiments of said voltage referencing circuit comprising a transistor which operates as a drive transistor regulating a drive current directed to a light emitting element in the pixel are provided.

The present invention further provides preferred embodiments of pixel circuits within which a scan electrode further operates to deliver a full drive current to a light emitting device in the pixel. Such a multi-functional scan electrode is different from a conventional scan electrode which performs a narrower function of selecting pixels for data input. Such multi-functional scan electrode is herein referred to as scan-power electrode.

As a preferred embodiment of the present invention, the data setting circuit between a data electrode and a scan electrode is structured to convert a data current directed thereto to a data voltage. Such data voltage sets the voltage of the storage element in the pixel. Such a stored data voltage controls a drive current to the light emitting element in a pixel. Preferred embodiments are provided for the data setting circuit comprising a data setting transistor which generates said data voltage at the gate terminal of the data setting transistor.

Preferred embodiments of the present invention are provided to illustrate applications of such pixel circuits and drive method in current drive scheme for light emitting device display.

Preferred embodiments of the present invention are provided for the operation of a display in current drive scheme to eliminate dependency on threshold voltage variation and OLED characteristics. Preferred embodiments in three-transistor implementation are provided to illustrate the application to the solutions for current drive scheme for light emitting device display. Furthermore, current drive scheme is demonstrated in common cathode, n-channel transistor drive configuration.

The present invention provides pixel circuits and a drive method to operate said pixel circuits, where a pixel comprises a conducting channel between a data electrode and a scanning electrode; the enabling and inhibiting of such conducting channel are fully operated by the control signal voltages applied to the scan electrode.

The present invention provides a display comprising at least a pixel, a data electrode, and a scan electrode. The pixel comprises at least a data setting transistor and a capacitor comprising two ends. Said data setting transistor generates a data voltage and sets one end of the storage element to this data voltage during a data setting period when a scan signal is applied to a scan electrode; wherein said scan electrode further sets the voltage of the other end of the capacitor to the same level as said scan electrode during said data setting period.

Additional features and advantages of the present invention will be set forth in the description which follows, or may be learned by practice of the invention. The objectives and other advantages of the invention will be realized and attained by the structure particularly pointed out in the written description and claims hereof as well as the drawings.

DETAILED DESCRIPTION OF THE INVENTION

The present invention is directed to the operation of active matrix displays. Preferred embodiments and respective claims are described in light of the application to light emitting device display.

Preferred embodiments of the present invention are herein described using organic light emitting diodes as illustration. Examples of using organic material to form an LED are found in U.S. Pat. Nos. 5,482,896 and 5,408,109, and examples of using organic light emitting diode to form active matrix display devices are found in U.S. Pat. Nos. 5,684,365 and 6,157,356, all of which are hereby incorporated by reference.

Herein in this specification, voltages and potentials in an embodiment are referenced to a reference voltage level VREF in that embodiment. The meaning of voltage and potential are thus interchangeable within each respective case. Claimed subjects follow the same descriptive convention.

Figure 1:
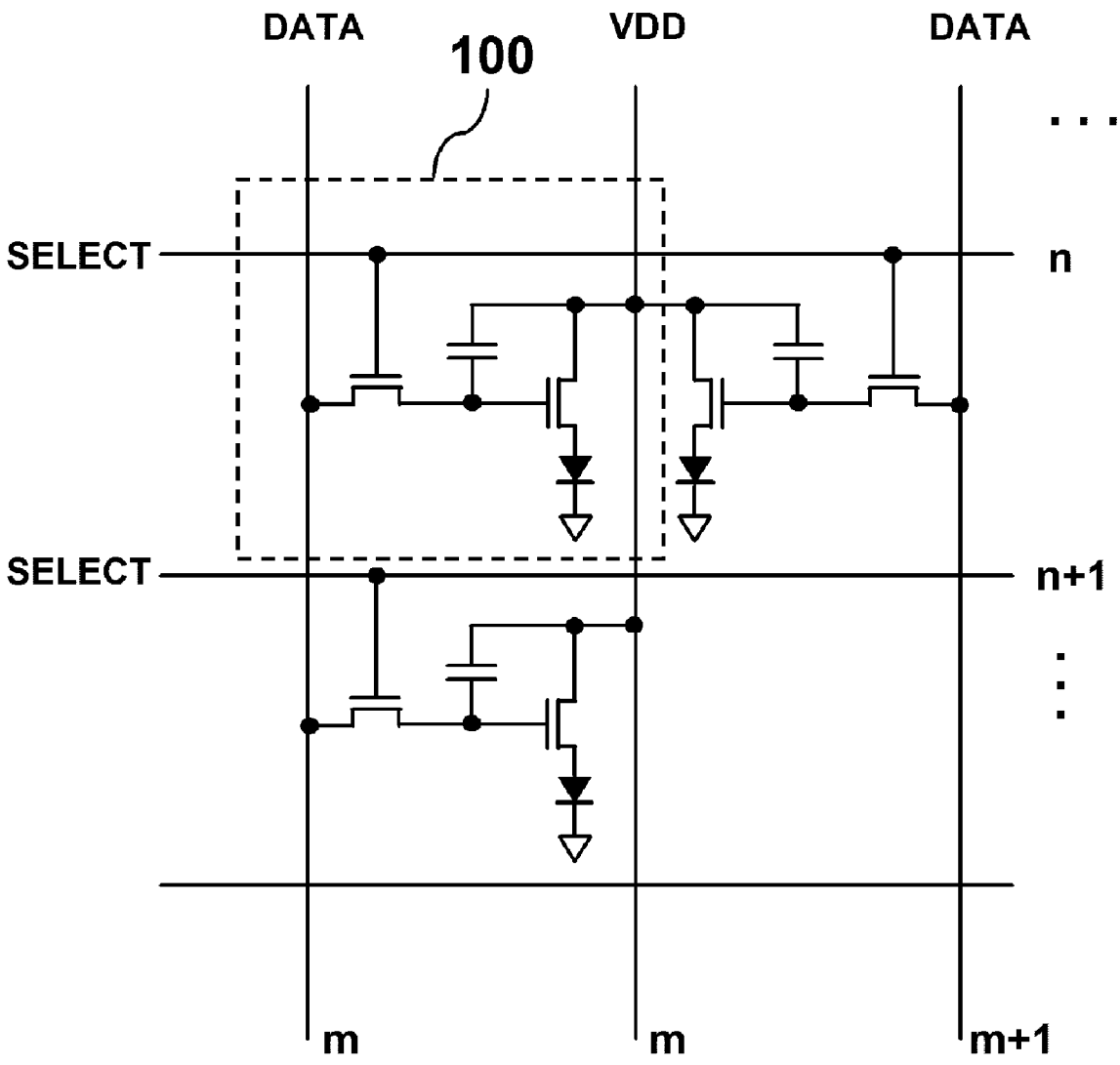
Fig. 1 (Prior Art)
FIG. 1 is a schematic of a prior art active matrix light emitting device display.
Figure 2:
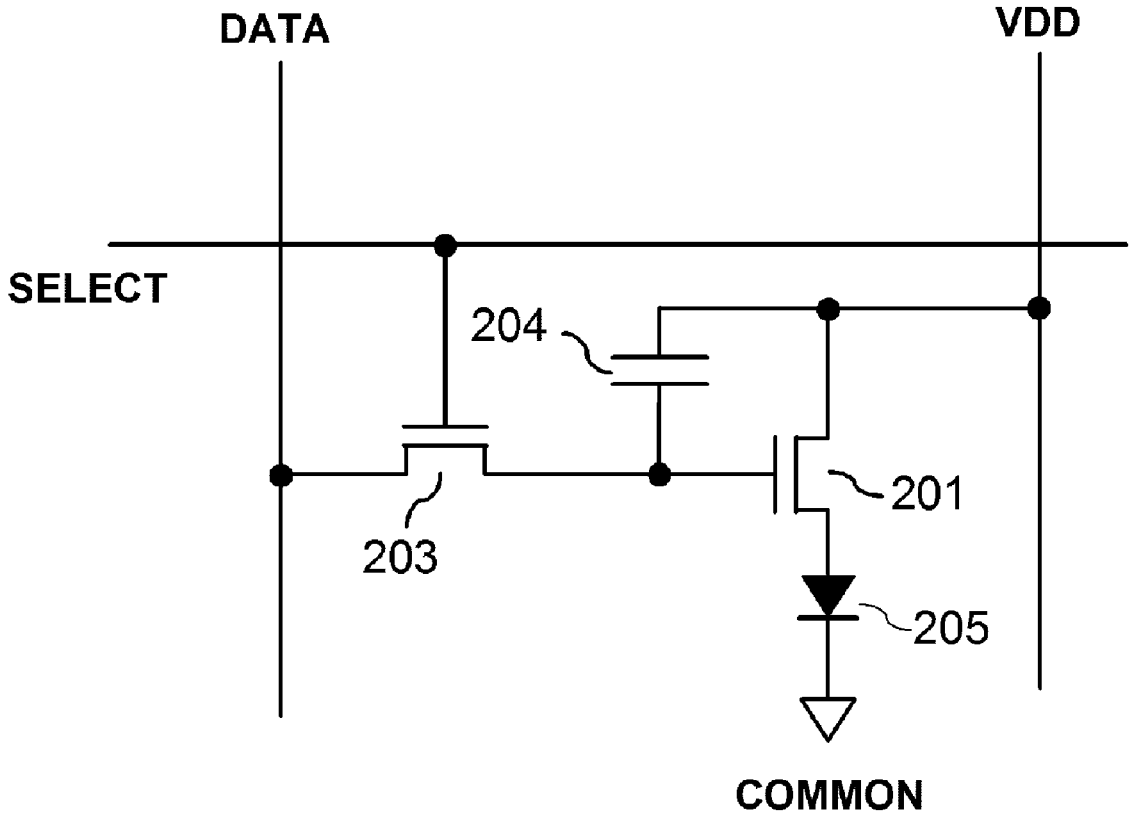
Fig. 2 (Prior Art)
FIG. 2 is a schematic of a prior art pixel circuit in an active matrix light emitting device.
Figure 3:
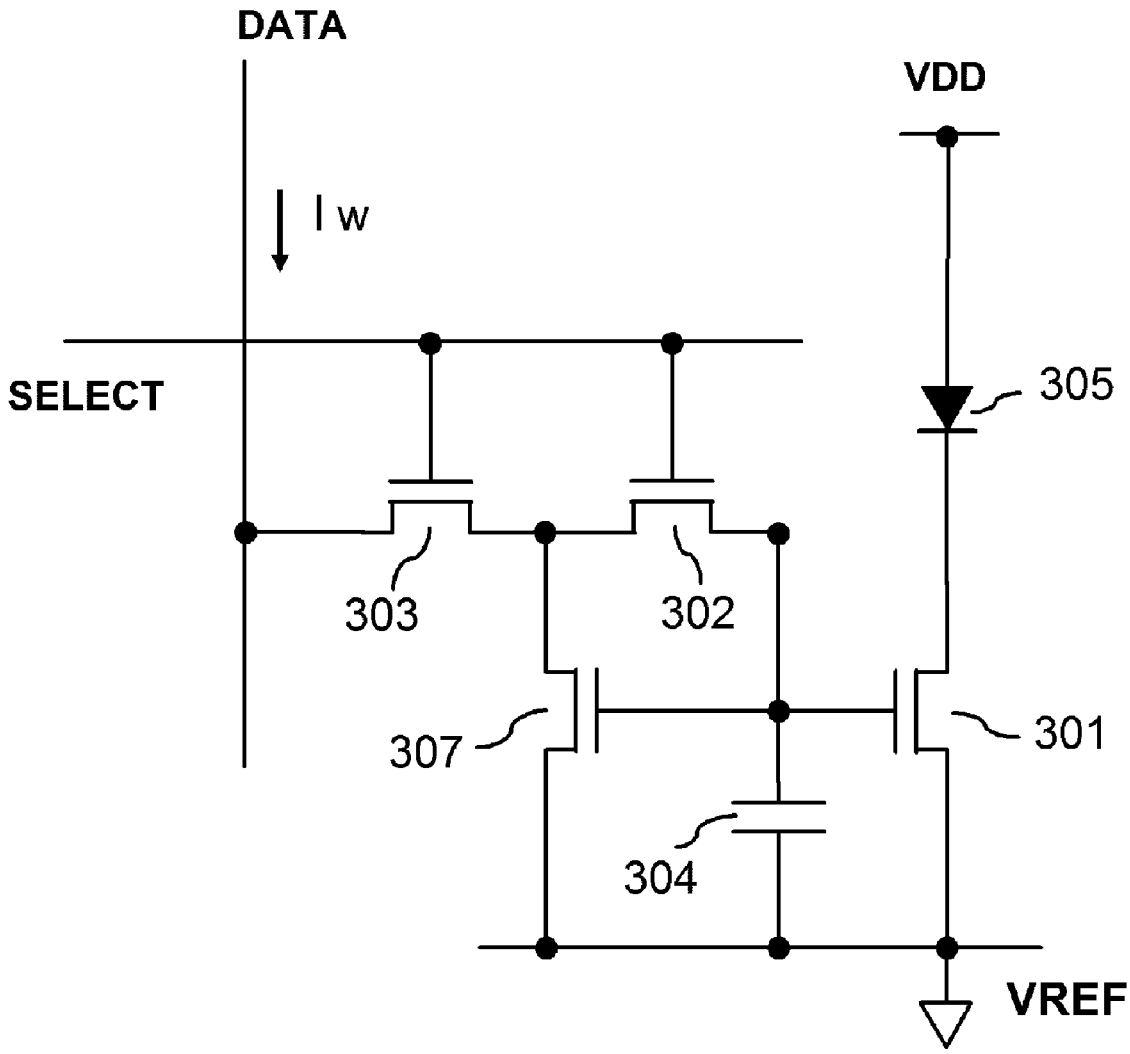
Fig. 3 (Prior Art)
FIG. 3 is a schematic of a prior art pixel circuit in an active matrix light emitting device.
Figure 4:
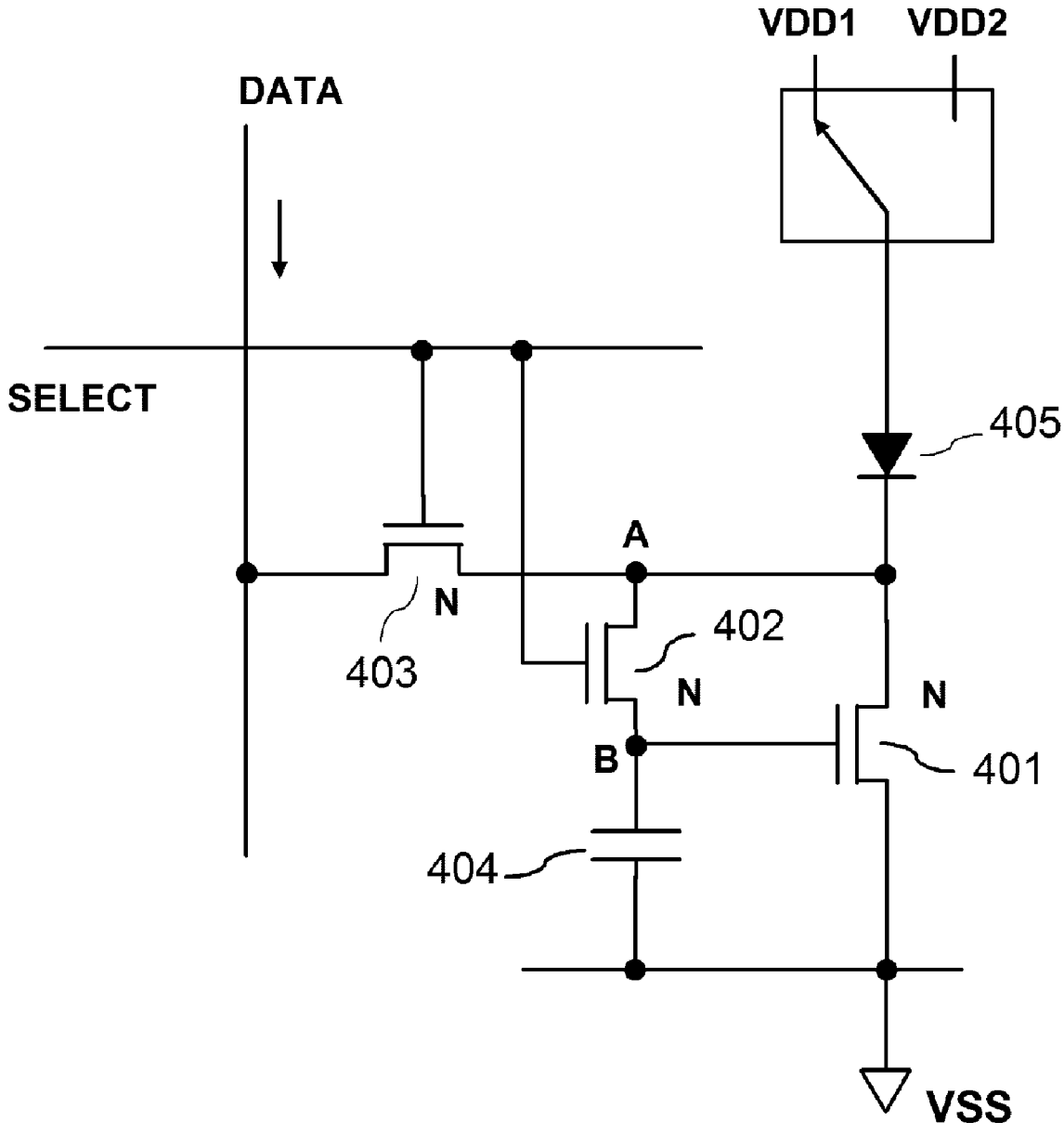
Fig. 4 (Prior Art)
FIG. 4 is a schematic of a prior art pixel circuit in an active matrix light emitting device.
Figure 5:
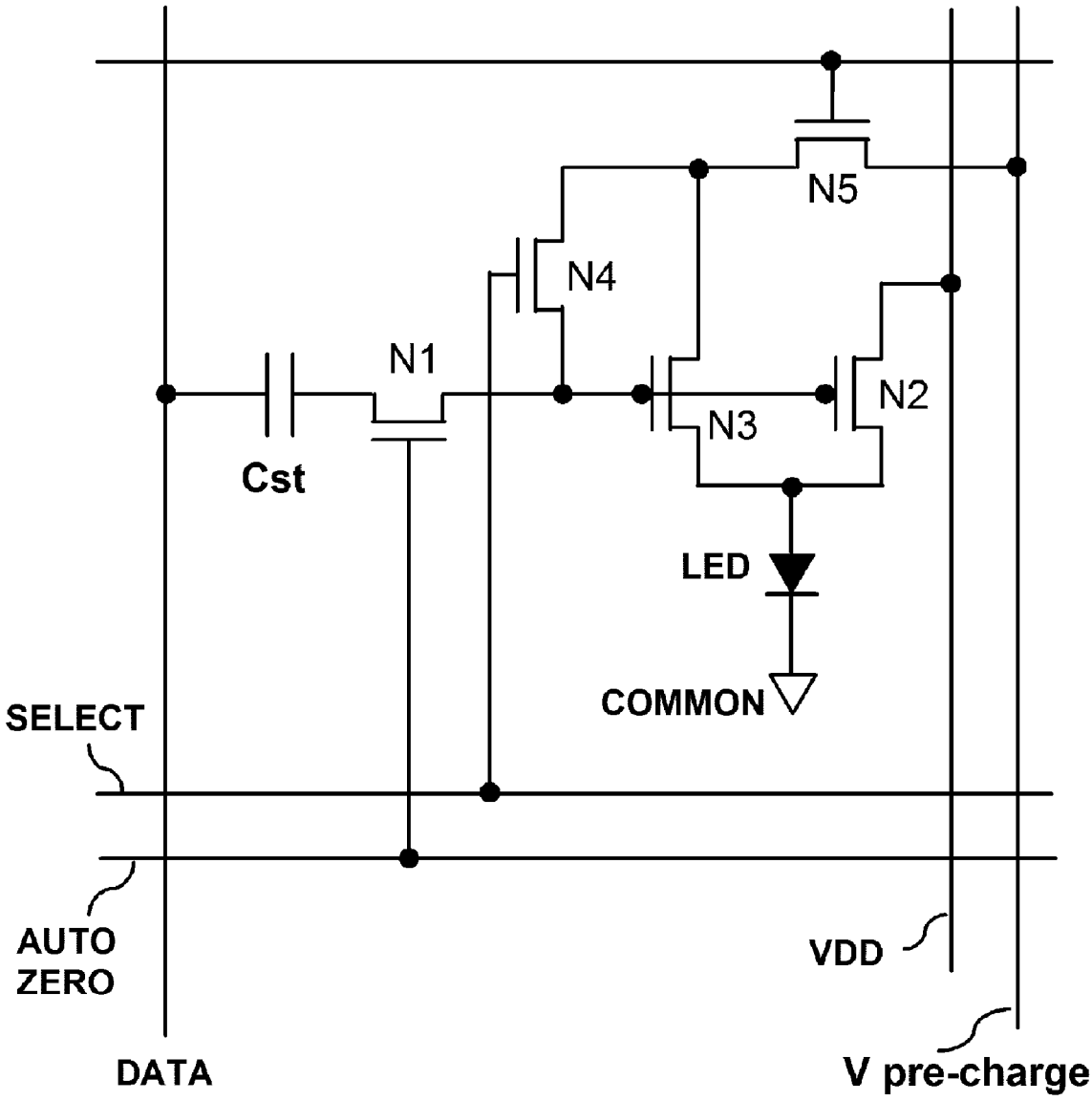
Fig. 5 (Prior Art)
FIG. 5 is a schematic of a prior art pixel circuit in an active matrix light emitting device.

As evidenced in the prior art illustrated in FIG. 2 to FIG. 4, the conventional method of constructing and operating an active matrix display involves a scanning electrode (or referred to as SELECT electrode, GATE electrode, or other names carrying similar meaning) and a power supply electrode (VDD). Such conventional scanning electrode operates to deliver switching signals to the gates of transistors in a pixel to turn said transistors on and off. In the prior art, one end of a storage element that holds a data voltage in a pixel is connected to the gate of a drive transistor and the other end is either connected to a reference voltage that does not adjust its voltage to the circuit operation such as illustrated in FIG. 2 to FIG. 4, or is not referenced to any fixed voltage level in all operation periods of a display.

The present invention provides a data setting circuit in a pixel circuits that connects a data electrode and a scan electrode. Such data setting circuit conducts a current directed from a data electrode and a scan electrode. Such data setting circuit is controlled according to a signal voltage applied to the scan electrode. Said data setting circuit is further arranged to provide a conversion function to convert a data current to a data voltage, and to set an internal storage element to said data voltage.

The present invention further provides a voltage referencing circuit comprising an active element, such as a MOS transistor, and a method to operate such that in a data setting period, one end of a storage element in a pixel is connected to a reference voltage via this active element that is configured in reverse direction of its configuration in other time. Such operation provides a fixed reference voltage to said storage element in a data setting period during which a data voltage is set to the storage element, while releasing the storage element from such voltage constraint in other period of operation.

The present invention provides active matrix pixel circuits and a method to drive such. The circuit comprises a conducting channel between a data electrode and a scan electrode. Enabling and inhibiting of said conducting channel is controlled by the signal applied to the scan electrode.

The present invention further combines with a scan-power electrode that operates to deliver drive power via a scan electrode. The same electrode that selects a pixel for data input delivers a full amount of drive current in a subsequent operating period. A pixel so constructed utilizes a scan-power electrode that delivers drive current while inhibiting data transfer between said data electrode and said pixel in one period, and enables data input from data electrode into said pixel according a scanning signal in another period.

A scan-power electrode represents an access electrode that is structured to perform both a scanning operation where a scanning signal is delivered to enable data input in selected pixels in one period of the operation, and a drive operation where a drive current is delivered to a light emitting device in another period of operation. A scan electrode represents an access electrode that performs a scanning (or select) operation. A scanning (or data setting, write) cycle is a period that a pixel is selected to allow data to be transferred from a data electrode to the selected pixel. The transferred data information is stored in a storage element in the pixel thereafter until the next scanning period.

In the description of this invention, a direct current path is a current path not interrupted by or ended on a capacitor; it may comprise such elements as resistor, drain-to-source and emitter-to-collector channel of a transistor, anode-to-cathode of a diode, and conductive lines that allow a current to continue. A direct current path in this description implies that it is enabled and conducts intended current in at least one of the operation periods for operating a display device. A charging current ended on or via a capacitor does not constitute a direct current path. Transient currents arising from charging of input gate or parasitic capacitors are not considered as providing valid current path. The reverse leakage of a diode, the leakage current in a transistor in its off-state, and current via the high impedance input terminals (such as a base or a gate) are also not considered as valid current paths. Accordingly, a direct current path in this description is a current path that allows the conduction of an intended current for the purpose of operating a display pixel, and allows such current to continue for as long as the set conditions persist.

An active element comprises a high-impedance control terminal and a channel between a second terminal and a third terminal, wherein the control terminal controls the current between the second and the third terminals. In operation, a control signal is applied to said high-impedance control terminal to regulates the current directed along said second and third terminals. The high impedance control terminal is also referred to as a gate. An MOS transistor having a gate as the control terminal, and the other two terminals arranged as source and drain is considered as a preferred embodiment of an active element in this description. Bipolar transistors and JFETs are alternatives as preferred embodiments. For those skilled in the art, it is well recognized that all such similar devices operate equally well as an active element in this description and in respective claims.

An organic light emitting diode (OLED) is used in most preferred embodiments wherever appropriate; the presence of such a device in such embodiments should not be construed as setting forth a limitation on the present invention directed for light emitting devices in general. MOS devices are used in preferred embodiments for switching elements. Similar bipolar transistors will perform similar functions as MOS devices. Those skilled in the art can quickly derive variations by a substitution of an arbitrary light emitting device for the organic light emitting diode, or by different types and polarities of switching devices. Preferred operating condition and preferred input data format do not necessitate limitations on the operation of the present invention.

A storage element includes one or a combination of a capacitor structure and parasitic capacitors.

Preferred embodiments of the present invention are provided for the current drive scheme to eliminate dependency on threshold voltage variation and OLED characteristics. Preferred embodiments in three transistor implementation are provided to illustrate the solutions for current drive scheme within the present invention.

The present invention comprises a combination of two features in a pixel circuit: (1) conducting channel between a data electrode and a scan electrode that generates and sets a data voltage to a storage capacitor from a data current, and (2) a drive transistor that reverse its source and drain in a data setting period to provide a reference voltage level through said drive transistor to said storage capacitor. This method provides a solution to construct a common-cathode pixel while using an n-channel drive transistor in current control mode.

The present invention may also be viewed as a pixel circuit comprising a data setting circuit connecting a data electrode and a scan electrode, wherein said data setting circuit generates and sets a data voltage to a storage capacitor from a data current, in conjunction with feature (2) described hereinabove.

Preferred embodiments of the present invention will hereinafter be described in detail with reference to the drawings.

Figure 6:
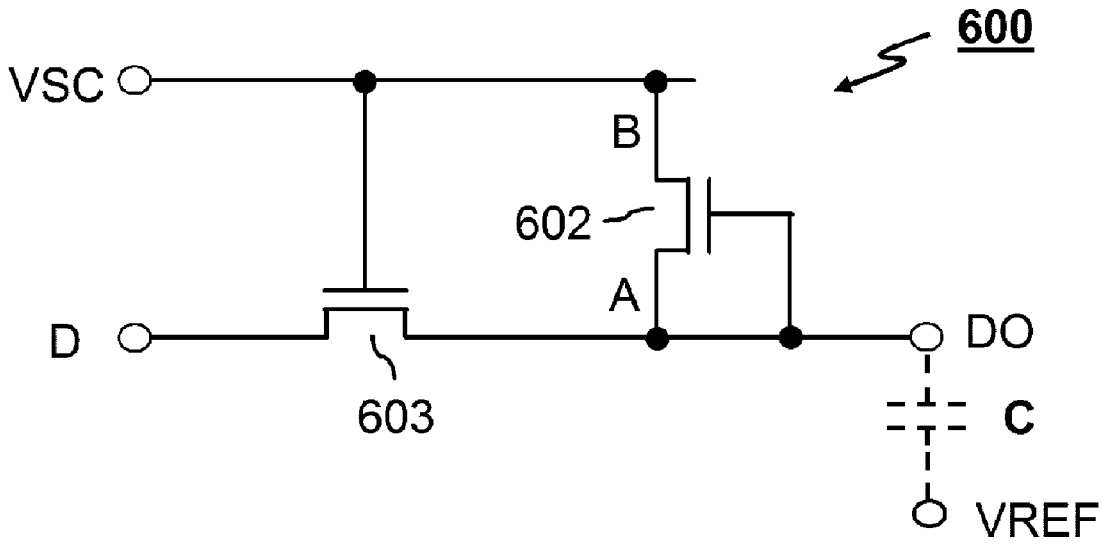
FIG. 6 is a schematic diagram of a preferred embodiment of a data setting circuit in the present invention.

The drive scheme provided in the present invention may be operated with a preferred embodiment of a data setting circuit element provided in FIG. 6, comprising a data setting transistor 602 and another transistor 603. One of the two source-drain terminals, terminal A, of 602 is connected to the gate of 602, and the other terminal (B) is connected to the gate of transistor 603 where a control voltage VSC is provided. The drain of 603 is connected to A-terminal of 602; the source of 603 is connected to an input electrode D. Such a data setting circuit element may be embedded in a pixel with additional elements attached to it, such as storage capacitor, drive transistor, and resistors.

In a preferred operation of FIG. 6, 602 may be assigned an n-channel transistor, and 603 a p-channel transistor. Terminals A and B of n-channel 602 operate as source and drain, respectively, when VSC is more positive than DO, or as drain and source, respectively if VSC is negative relative DO. Referring to such an implementation, when the potential of VSC is substantially lower than D (by more than the threshold voltages of 603), p-channel 603 turns on, making A-terminal more positive than B. This condition sets A-terminal a drain and B-terminal a source of n-channel transistor 602, and $V_{GS}=V_{DS}$ as the gate is short to the drain. When VSC is set high and more positive than D and DO, p-channel 603 is turned off, and A-terminal of n-channel transistor 602 is turned into a source and B-terminal a drain, giving $V_{GS}=0$ as the gate of 602 is short to the source. This configuration sets output terminal DO in a high impedance state since both 602 and 603 are in off-state. Since DO is typically connected to a storage capacitor in subsequent preferred embodiments of pixels, a preferred operating condition for circuit 600 requires a scanning voltage VSC being switched between a $V_{HI}$ and a $V_{LO}$ where the dynamic range (which is the voltage difference between $V_{HI}$ and $V_{LO}$) is greater than the total combined dynamic range of data signal and the voltage range in VR. Noted here is that the reference voltage VREF for capacitor may be a dynamically varying voltage level in a pixel operation that provides a fixed reference voltage only in a period when it is desirable.

According to embodiment of FIG. 6, providing a current is directed from the data electrode D to the scan electrode "VSC" via 602, in a period when VSC is set negative relative to D, the data setting transistor 602 converts such a current to a data voltage at the node DO, according to a saturation operating condition of the transistor characteristic.

Figure 7:
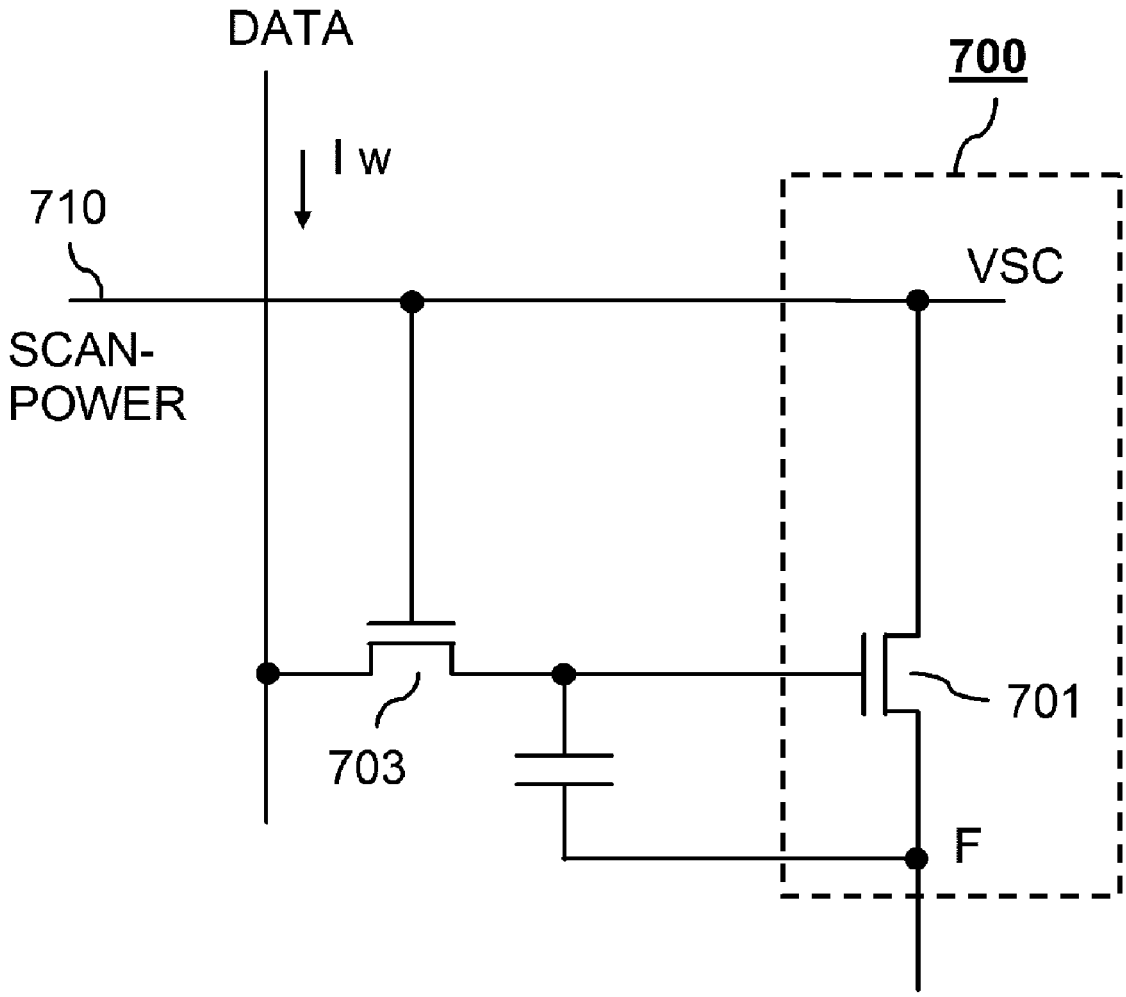
FIG. 7 is a schematic diagram of a preferred embodiment illustrating a dynamic voltage referencing of the storage capacitor.

In addition to the data setting circuit described in a preferred embodiment of FIG. 6, the present invention further provides a pre-determined fixed voltage reference to the capacitor for data setting in a scanning cycle, whereas the capacitor's connection provides a voltage level that is adjusted to the drive condition in a drive cycle rather than to a fixed level. Such a dynamic referencing scheme, as opposed to a fixed voltage connection for all operating periods, is illustrated in a preferred embodiment in FIG. 7. In a drive cycle, point F is not assigned any fixed voltage level. The voltage at node F is the source voltage of transistor 701 that is adjusted to the circuit operating condition according to the drive current in 701, the gate voltage of 701, and the characteristic of the drive transistor 701. In a scanning cycle, the scan-power electrode 710 is switched from a drive voltage to a scanning voltage that is set to be the lowest voltage level in this circuit to reverse the direction of the source and drain of transistor 701 and to inhibit any drive current beyond node F as the voltage of node F is set low by VSC via 701. Said scanning voltage also turns on transistor 703, allowing data signal to reach the gate of transistor 701. Any positive data value then turns on transistor 701 and resets the point F to said scanning voltage that is the voltage VSC of the scan electrode via 701.

Figure 8:
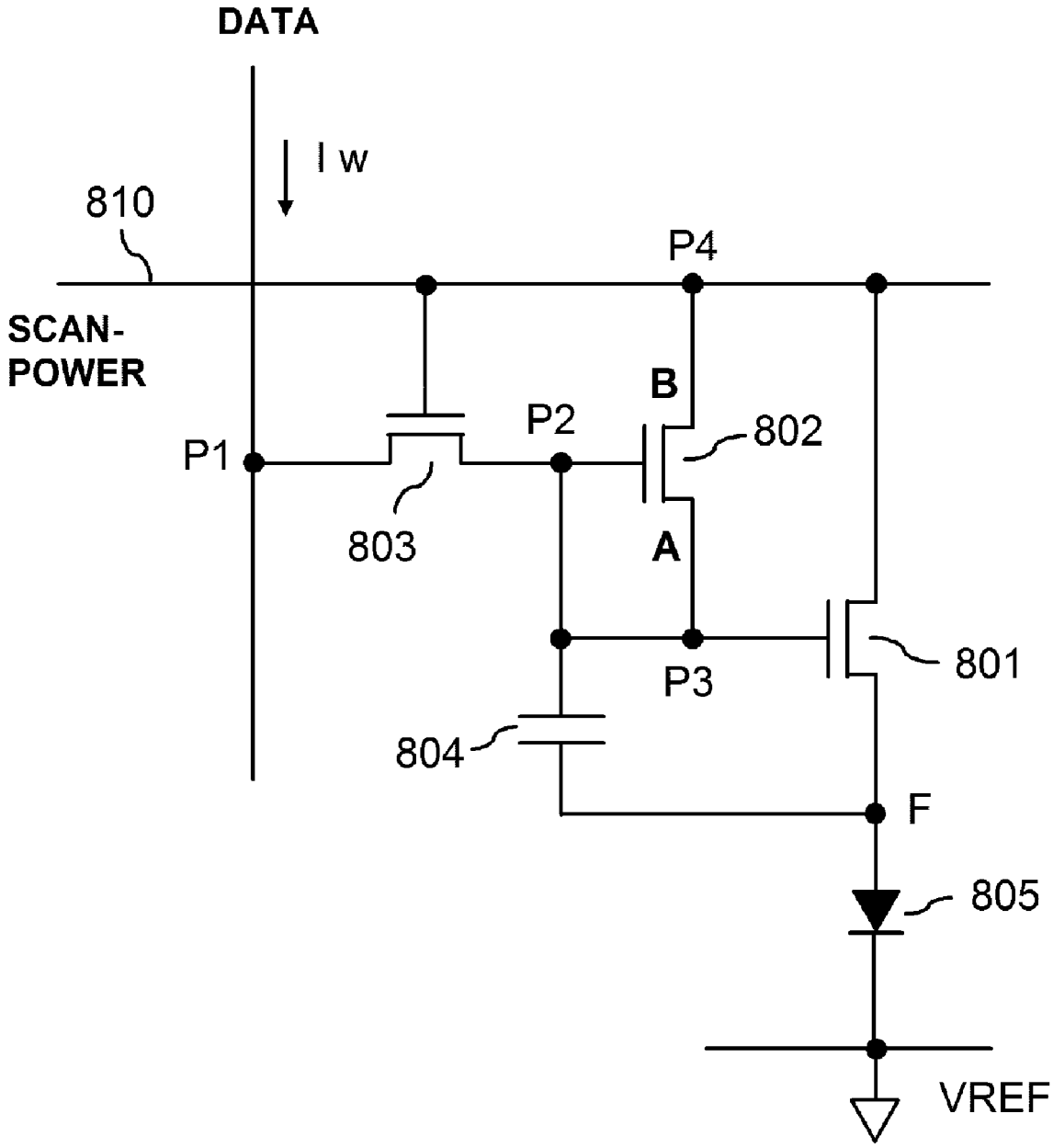
FIG. 8 is a schematic diagram of a preferred embodiment of pixel circuit in present invention.

FIG. 8 provides an example of a preferred embodiment of the present invention utilizing the methods and circuit elements described above. In FIGS. 8, 802 and 803 are the equivalent of 602 and 603, 801 is the equivalent of 701, and 804 is a storage capacitor. The storage capacitor 804 is connected to the gate of transistor 801 to retain data information for controlling drive current of OLED 805. The cathode of OLED 805 is connected to a common reference voltage source VREF.

A preferred implementation of FIG. 8 provides a p-channel transistor 803, and n-channel transistors 801 and 802. The control voltage applied to scan-power electrode 810 alternates between $V_{LO}$ in a scanning period and $V_{HI}$ in a drive period, where $V_{LO}$ enables the pixel for data writing (scanning cycle) and $V_{HI}$ isolate the pixel from data electrode and provides a drive current to the light emitting element 805 (drive cycle). The level of $V_{LO}$ should be set well below the onset voltage of OLED to prevent any voltage increase in 801 due to current in 805 in a scanning cycle. The voltage range from $V_{LO}$ to $V_{HI}$ should be greater than the sum of the dynamic range of data input and the maximum forward voltage of OLED 805, to prevent data saturation. $V_{LO}$ is typically the lowest level and $V_{HI}$ the highest in the circuit. A convenient setting is to set $V_{LO}$ the same as VREF. Taking polymer light emitting diode as an example (for 805), a typical forward voltage drop for active matrix application is within 5V, and a dynamic data range is within 5V. A proper setting for $V_{HI}$ is thus 10V above $V_{LO}$. Taking $V_{LO}$ as the ground level (0V), the scan-power electrode will then be sequenced between 0 and 10V in an actual operation of such active matrix displays.

With reference to the circuit of FIG. 8, in a preferred operation, data information is formatted in a form of current source $I_W$. A preferred operation of said circuit is described hereinafter:

1. Data signal and desired output. When a current is conducted in an OLED, the light output of the OLED is conveniently considered linear to the drive current. In order to maintain a uniform control of light output insensitive to the variation from pixel to pixel, it is highly desirable to devise a pixel circuit that provides a transfer function converting input signal from a data electrode linearly into output current on OLED. Such a transfer function needs to be independent of variation of major parameters in a pixel circuit such as threshold voltage of the control transistors and OLED forward voltage. It is recognized in the art that such a site-independent transfer may be better accomplished by using data signals in the form of current source, as illustrated in prior art. Accordingly, the discussion here focuses on the operation using current source $I_W$ delivered on a data electrode to produce a current output $I_D$ on an OLED. For example, in a preferred format, any data information is formatted in the form of a data current, where the data current is proportional to the brightness of the corresponding data point of the information to be displayed. For example, to display an image in 64 levels of gray scales, each increment in the gray scale corresponds to 1/(64-1) of the maximum current that corresponds to the full brightness level. A preferred circuit and its operation are expected to produce an output current in a drive cycle that is converted linearly from the input data current in a scan cycle.

2. Scanning (data setting, wrtie) cycle. A voltage low $V_{LO}$ is applied on a scan-power electrode 810, turning on p-channel transistor 803 and allowing data current $I_W$ to enter the pixel, where $V_{LO}$ is set to be equal to VREF, and is set to be the lowest potential in a display system. As input data current $I_W$ is directed toward the gates of n-channel transistors 802 and 801 and capacitor 804, any non-zero current will accumulate positive charge (and voltage) on the gates of 802 and 801, turning on both transistors, as discussed above for 600 and 700. As transistor 801 is turned on, floating point F is thus reset to $V_{LO}$ as a fixed reference level for capacitor 804. The data information is therefore properly registered into capacitor 804 with reference to $V_{LO}$. On transistor 802, a positive voltage on the gate and A-terminal sets A-terminal a drain and B-terminal a source, as discussed above for 600. Transistor 802 then has a configuration of drain-to-gate short, and provides $$V_{GS2}=V_{DS2} \tag{1}$$

where $V_{GS2}$ is the gate-to-source voltage of transistor 802, and $V_{DS2}$ is the drain-to-source voltage drop on 802.

According to the characteristics of MOS transistors, the condition given in Eq. (1) ensures that 802 is at the onset of saturation, and the current (ID) through 802 is controlled by the gate voltage according to a formula:

$$I_{D2}=C_2(V_{GS2}-V_{TH2})^2 \tag{2}$$

where $V_{TH2}$ is the threshold voltage of 802, and $C_2$ is a constant determined by the width, length, and intrinsic parameters such as the mobility of silicon, the thickness and dielectric constant of the gate oxide of transistor 802. Approaching the end of a scan cycle, the current branched into the capacitor 804 diminishes to zero, and the entire data current $I_W$ is channeled through transistor 802, thereby giving $$I_{D2}=I_W, \tag{3}$$

It should be noted that the voltage drop $V_C$ on capacitor 804 is the same as $V_{GS2}$, $V_{GS2}=V_C$, since the line voltage on 810 is at the same level as VREF in a scanning cycle.

3. Drive cycle. After data is written into a pixel and the capacitor 804 charged to a voltage $VC=V_{GS2}$ that sets transistor 802 in saturation region, electrode 810 is set to a voltage high ($V_{HI}$) sufficient to provide a full forward bias on OLED 805, and to keep transistor 801 in its saturation region. A preferred voltage high ($V_{HI}$) is typically equal to, or higher than the sum of the maximum OLED forward operating voltage and the dynamic data range of input data. Such a condition for $V_{HI}$ ensures that the drain-to-source voltage drop $V_{DS1}$ of transistor 801, in a drive cycle, is higher than the stored voltage $V_C$ in the capacitor 804 set in a scan period, thereby forcing transistor 801 into its saturation region. As electrode 810 being set high, p-channel transistor 803 is turned off. Transistor 802 has its drain and source reversed from the scanning cycle as described above in the discussion related to FIG. 6, as the voltage on scan-power electrode 810 being set above the stored capacitor voltage $V_C$. Transistor 802 is thereby turned off as its gate is at the same potential of its source (A). This completely isolates capacitor 804 from any external influence. The charge accumulated in capacitor 804 from a scan cycle is thereby retained for as long as parasitic leakage current permits. Simultaneously, OLED 805 becomes forward biased as its anode is at a positive potential relative to VREF. With the conditions provided above for $V_{HI}$, and an I–V analysis of operating conditions of transistor 801, it can be verified that $V_{DS}\geqq V_{GS}$ in a drive cycle. The transistor 801 therefore remains in the saturation region, and $I_D$ is given by a similar formula as above:

$$I_{D1}=C_1(V_{GS1}-V_{TH1})^2 \tag{4}$$

where $I_{D1}$ is the current through 801, $C_1$ is a constant determined by the width, length, and intrinsic parameters such as the mobility of silicon, the thickness and dielectric constant of the gate oxide of transistor 801, and $V_{GS1}$ is the gate-to-source voltage of transistor 801 in a drive cycle, noting that $V_{GS1}=V_C=V_{GS2}$.

Given the close proximity between 801 and 802, all the intrinsic parameters and the thickness of oxide are expected to be fairly the same for both. That gives $V_{TH1}=V_{TH2}$, and the C's only be different through dimensional parameters of length and width by design. It is straightforward for those skilled in the art to conclude that the current $I_{D1}$ so delivered in a drive cycle is given proportional to the input current $I_W$ by $$I_{D1}/I_W=C_1/C_2=W_1L_2/W_2L_1 \tag{5}$$

or $$I_{D1}\propto I_W$$

The drive method and pixel circuit provided herein thus provide a three-transistor solution in current control mode, using n-channel drive transistor pixel circuit in common-cathode structure; the drive current output is not susceptible to the variation in characteristics of its circuit elements such as the threshold voltage of transistors. The ratios of dimensional parameters in Eq. (5) are constant by design, and remain constant to the first order of process variation, thereby providing a transfer function that is fairly independent of geometry change due to non-uniformity in processing. It should be noted that the linearity between the input and output is a preferred transfer characteristics, but not a necessary condition for this invention to operate. It should also be noted that the ratio $C_1/C_2$ is not necessarily the same for all current levels. A slightly higher $C_1/C_2$ at lower current $I_W$ than at higher $I_W$ is typical. This is due to the condition of a constant total voltage applied across the combined light emitting element 805 and transistor 801, thereby causes an increase in drain-to-source voltage $V_{DS1}$ on drive transistor 801 from $V_{DS2}$ that set $V_C$. Such a deviation of $V_{DS1}$ from $V_{DS2}$ is more significant at lower $I_W$ than at higher $I_W$, and thus driving 801 further into saturation from the onset point at lower current $I_W$. For transistors exhibit incomplete saturation, this shift of $V_{DS}$ causes an increase in $C_1$, and a deviation of the ratio $C_1/C_2$. To the first order of operation, this deviation may be neglected; for more accurate image reproduction, this deviation may be compensated in input $I_W$, or with additional offset elements.

As another example of a preferred operating condition, considering a pixel circuit comprising a small-molecule OLED operating in 8.5V range, a typical NMOS TFT for drive transistor, and a dynamic data range of 3.3V, a preferred voltage high ($V_{HI}$) will be in the range of 12-13 volts above VREF. Such a condition for $V_{HI}$ ensures that the data information corresponds to upper current level is properly reproduced in the output according to the same prescribed linear relation.

According to embodiment of FIG. 8, during the scanning period where a scanning signal is applied to the scan-power electrode, a conversion transistor 802 converts a data current directed from the data electrode to the scan electrode via 802 to a data voltage at one (first) end of the capacitor 804 according to the transistor characteristic of 802. This data voltage is provided at the first end of the capacitor 804, while the second end of capacitor 804 is set to the same voltage as the voltage on the scan-power electrode via transistor 801.

In a data setting (write) period, the voltage on the scan-power electrode is lower than the gate and F end of transistor 801, making the F end of transistor 801 a drain in reverse of that in a drive period wherein the F end operates as a source of transistor 801. In a data setting period, F node is at the same voltage as that of the scan-power electrode.

In a drive period, the voltage at F-node is released from the voltage constraint of that in a data setting period, and adjusts itself according the operating current in transistor 801 and the forward voltage of light emitting element 805.

In the preferred embodiment of FIG. 8, the pixel drive current in a drive period is independent of the threshold and the forward voltage of the light emitting device 805. The drive current if thus fully controlled by the input data current, providing a solution to current drive mode in a common cathode configuration with n-channel drive transistor.

As described hereinabove, the preferred embodiment in FIG. 8 further provides, as a first additional perspective, an illustration of a current path (P1-P2-P3-P4) connecting said scan-power electrode as a first access electrode and said data electrode as a second access electrode, via A-terminal and B-terminal of transistor 802 and the source and drain of transistor 803. Such a current path conducts a current equal to the data current in a scanning cycle. The scanning cycle is controlled by applying a scanning voltage on the scan-power electrode.

It should be noted that various electrical elements may be further inserted or divided in such a current path to further modify the operation. These further modifications shall be construed as not violating the provision of a current path between a scan-power electrode and a data electrode to incorporate a drive function into the same scan-power electrode, as described in the present invention.

The preferred embodiment of FIG. 8 provides, as a second perspective, a demonstration of the functions of terminals A and B of transistor 802 as being drain and source varying in different operating cycles. The function of A and B terminals as being drain or source is not statically fixed at the time of design of a pixel circuit, but rather alternates on the operation voltage applied on said scan-power electrode. In this respect, it is more appropriate to refer to these terminals as second and third terminals (in addition to the gate terminal) in this description and in the claims.

The preferred embodiment of FIG. 8 further provides, as a third perspective, a data setting circuit as provided in FIG. 6, comprising transistors 802 and 803 that convert input signal in a current form to a voltage form, and deliver such voltage to the storage capacitor 804. A current path connecting the scan-power electrode and data electrode is provided via such data setting circuit.

As another feature of this preferred embodiment, said data setting circuit comprises a data setting transistor 802, wherein a data voltage is generated at the gate (P2) which is in common with the source (P3) of transistor 802 while passing a current from the data electrode and the scan electrode via transistor 802. Said data voltage sets the voltage of the capacitor 804.

During the period when a drive voltage ($V_{HI}$) is applied to the scan-power electrode, all paths leading to the storage element 804 are inhibited, isolating the capacitor (and the gate of transistor 801) from any other influence.

An active matrix display may be constructed from the pixel unit provided in this embodiment by forming such pixels at intersects between a plurality of data electrodes and a plurality of scan-power electrodes. As an example for a complete display unit, a current driver unit with matching number of output terminals is attached to the edge of such matrix display where each data electrode is connected to an output terminal of the data driver unit to provide data current signal. A scan-power driver is attached to another edge of such display matrix where each scan-power electrode is connected to an output terminal of the scan-power driver unit to receive scanning pulses and driver current.

In a preferred implementation of the embodiment of FIG. 6, the transistors are thin film transistors (TFT) formed on a layer of amorphous or polycrystalline silicon on a transparent glass substrate. The transistors may also be form on single crystal silicon substrate, and may be either MOS or bipolar device. The common reference voltage source is typically supplied through a continuous layer of conductive material connecting each and every pixel. The organic light emitting diode may be formed with a stack of layers of small-molecule or polymer organic materials. Such light emitting structure typically comprises a cathode layer, an electron-transport layer, a hole-transport layer, and an anode layer. An additional emitter layer is often provided between the electron-transport and the hole-transport layers to enhance the light producing efficiency. The data and scan-power electrodes are typically formed by first depositing or coating a layer or layers of conductive materials, and followed by a standard photolithography and etch processing techniques to define the pattern of such electrodes. In a preferred implementation, the storage element is a parallel-plate capacitor formed by sequentially preparing a first conduct layer, an insulating layer, and a second conductive layer, followed by a standard photolithography and etch processing to define a capacitor structure. A preferred method typically used to connect various device structures in a display circuit, such as the one presented in FIG. 6 of this invention, is by defining the device pattern and contact points with a photolithography and etch process. Various techniques used to produce the structures and connections needed for the implementation of the circuit in FIG. 6 are available in the art, and the examples of which are found in the documents incorporated by reference.

Figure 8B:
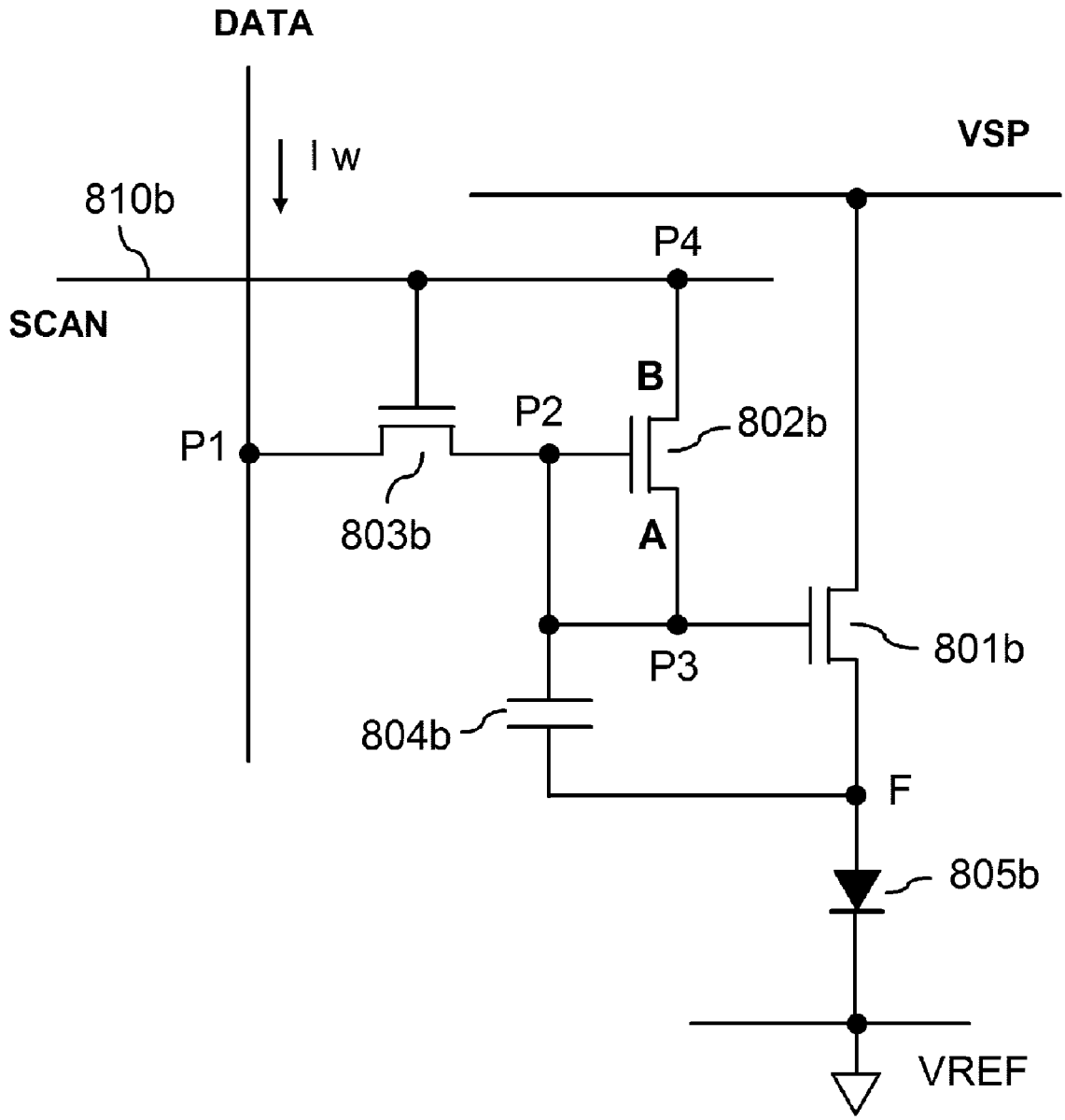
FIG. 8B is a schematic diagram of a preferred embodiment of pixel circuit in present invention.

FIG. 8B provides another preferred embodiment comprising two n-channel transistors 801*b* and 802*b*, a p-channel transistor 803*b*, a capacitor 804*b* and a light emitting diode 805*b*. 801*b* and 802*b* are the equivalent of 602 and 603, 801*b* is the equivalent of 701, and 804*b* is a storage capacitor. The storage capacitor 804 is connected to the gate of transistor 801*b* to retain data information for controlling drive current of OLED 805*b*. The cathode of OLED 805*b* is connected to a common reference voltage source VREF. This embodiment is similar to FIG. 8 except that the power supply electrode VSP is separated from a scan electrode. In a preferred operation, the power electrode VSP is set to the same voltage as scan electrode in a data setting (write) period, thereby setting the voltage of capacitor 804*b* in the same manner as in FIG. 8. In a drive period, the VSP is brought to a power supply voltage level $VSP_{HI}$ to provide a drive current in a similar manner as for FIG. 8, except that $VSP_{HI}$ may be set to be higher than the switching voltage $V_{HI}$ on a scan electrode to provide a broader data range than having the supply voltage tied to the scan voltage.

Figure 9A:
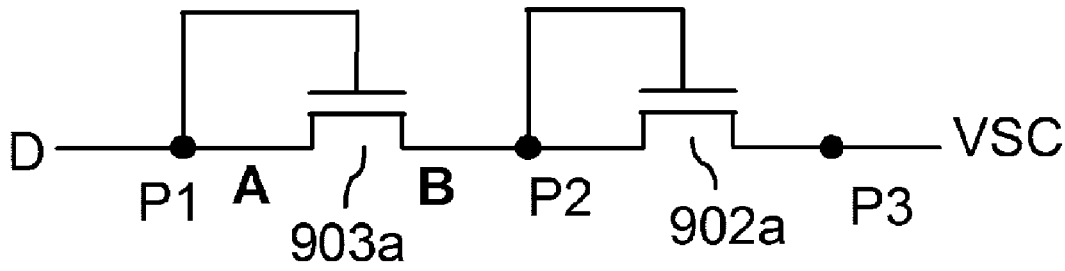
FIG. 9A is a schematic diagram of a preferred embodiment of a data setting circuit in the present invention.
Figure 9B:
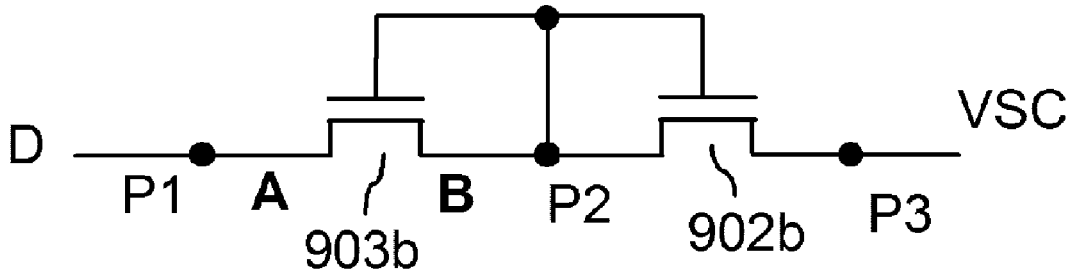
FIG. 9B is a schematic diagram of a preferred embodiment of a data setting circuit in the present invention.

Additional preferred embodiments of data setting circuit connecting a data electrode and a scan electrode are provided in FIGS. 9A and 9B. In FIG. 9A, two transistors are arranged along the conducting path between scan electrode VSC and the data electrode D. The gate terminal of each of the two transistors is connected to a second terminal (one of the source-drain ends of the respective transistor) which operates as a drain terminal when VSC is negative relative to D and as a source when VSC is positive relative to D. In a preferred operation, both transistors 902*a* and 903*a* are n-channel MOS transistor. Given an n-channel 902*a* and n-channel 903*a*, the conducting channel is enabled when the voltage at VSC is set lower than the voltage at D, turning on the n-channel 903*a* and n-channel 902*a*, and inhibited when voltage is reversed. The operation and voltage conversion may be derived in analogy to that provided above for FIG. 6. FIG. 9A further provides another preferred embodiment with both transistors 902*a* and 903*a* being p-channel transistors. The operating method may be described in analogy to the two n-channel transistors implementation described hereinabove with a reversed polarity.

FIG. 9B provides another preferred embodiment of a data setting circuit connecting a data electrode and a scan electrode, comprising an n-channel transistor 902*b* and a p-channel transistor 903*b*. The gate terminal of each of the two transistors is connected to a second terminal (one of the source-drain ends of the respective transistor) which operates as a drain terminal when VSC is negative relative to D and as a source when VSC is positive relative to D. Operations similar to that of FIG. 6 and FIG. 9A may be derived in analogy to the description provided for FIG. 9A.

Figure 10:
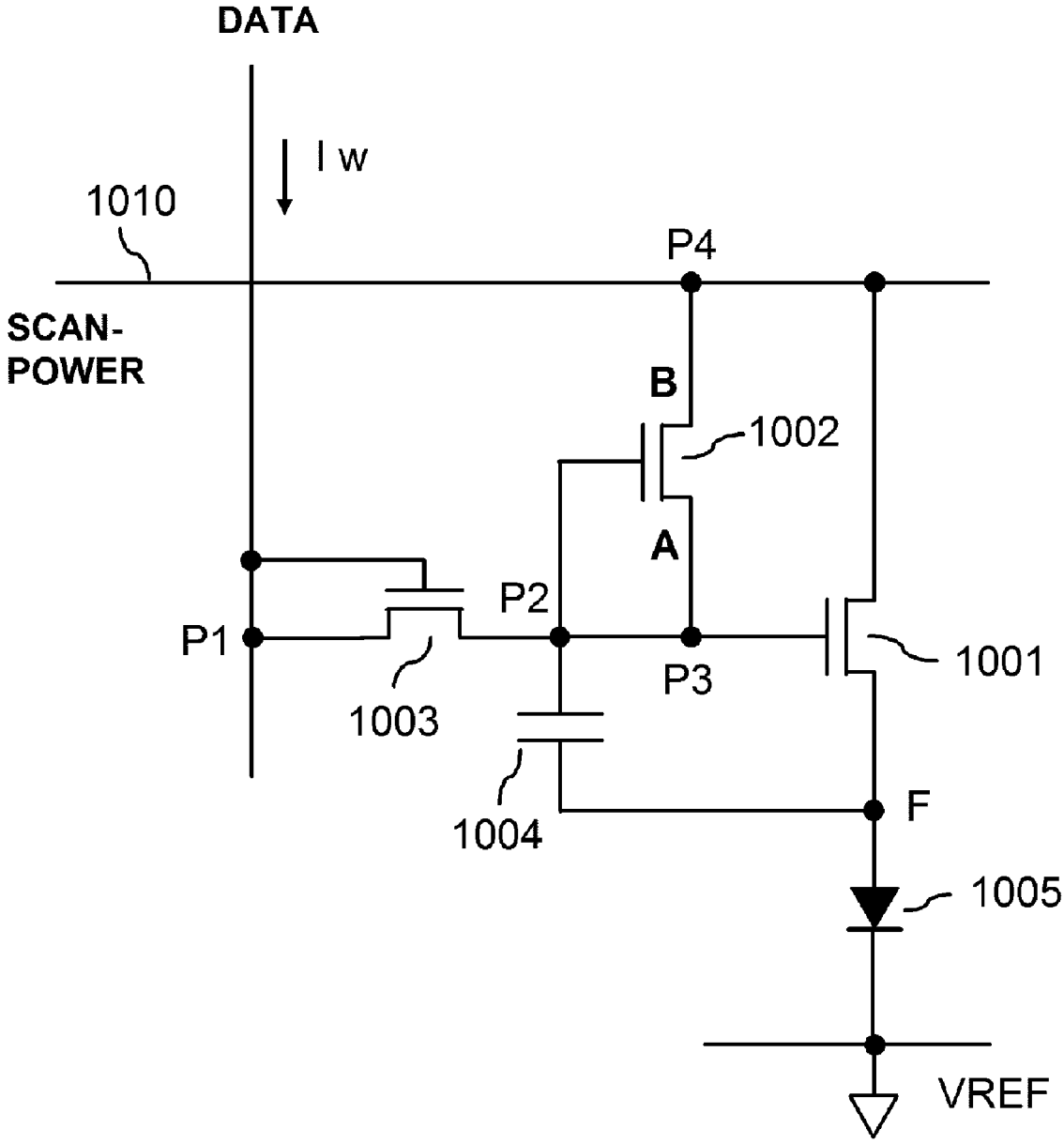
FIG. 10 is a schematic diagram of a pixel circuit in a preferred embodiment of the present invention.
Figure 11:
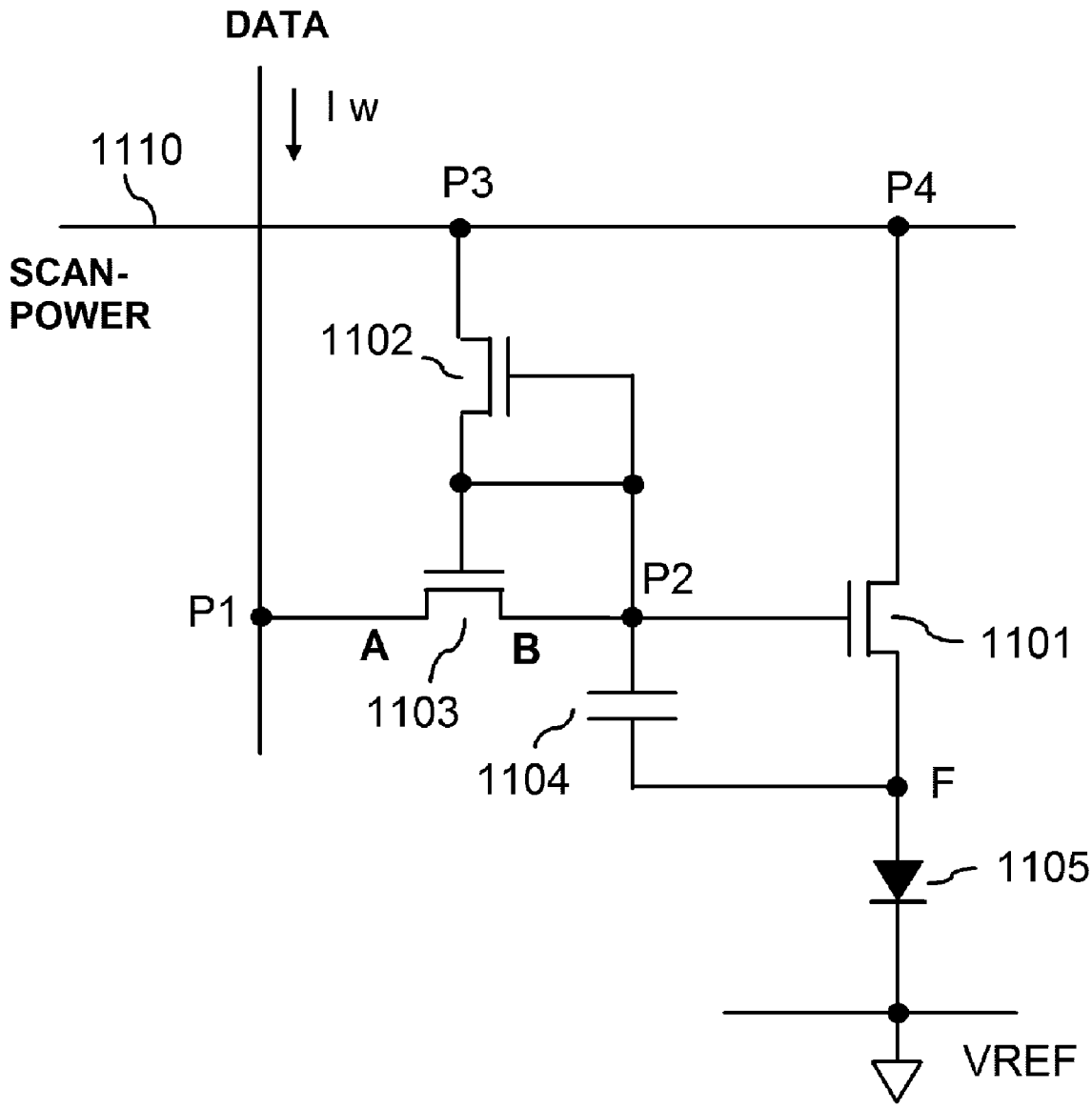
FIG. 11 is a schematic diagram of a pixel circuit in a preferred embodiment of the present invention.

Additional preferred embodiments of pixel circuits utilizing data setting circuit elements of FIGS. 9A and 9B are given in FIG. 10 and FIG. 11. FIG. 10 comprises a data setting circuit of FIG. 9, wherein two n-channel transistors 1002 and 1003 forms part of a conducting channel connecting the data electrode and the scan-power electrode, and wherein an n-channel drive transistor 1001 regulates a drive current directed to the light emitting device 1005 in a drive period, and wherein 1001 provides a reference voltage to the capacitor 1004 in a data setting period. The data setting transistor 1002 generates a data voltage at the gate node of 1002, and set the capacitor voltage to the same voltage in a scan (data setting) period. The operation condition and the procedure are in analogy to that provided for FIG. 8.

A preferred embodiment similar to FIG. 10 is provided in FIG. 11, wherein the data setting element of FIG. 9B is used. The operation condition and output characteristics are in analogy to the circuit of FIG. 10.

Figure 12:
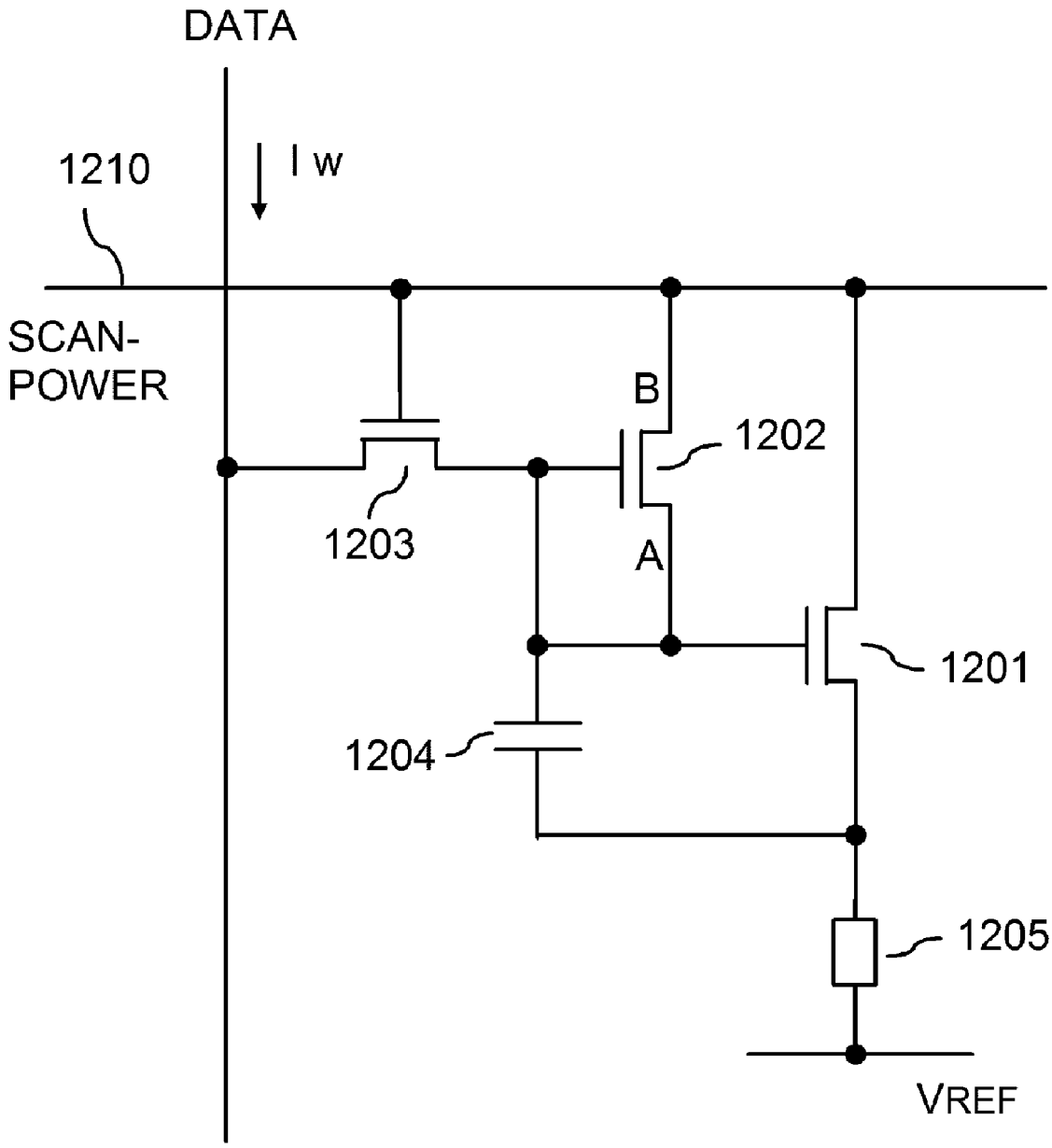
FIG. 12 is a schematic diagram of a pixel circuit in a preferred embodiment of the present invention, applying to a general light emitting device.

The operation of pixel circuits in FIG. 8 does not require any specific polarity on VDD, VREF, and light emitting element. Accordingly, a preferred embodiment for a pixel circuit applicable to different types of light emitting devices is provided in FIG. 12, wherein 1205 represents a light emitting device. A common-anode pixel structure for FIG. 12 is obtained by providing an n-channel transistor 1203, two p-channels transistors 1201 and 1202, light emitting element 1205 with its anode connected to VREF, and a storage capacitor 1204. It should also be noted that any of the above-mentioned preferred embodiment works equally well for 1205 being a bi-directional light emitting device.

Figure 13:
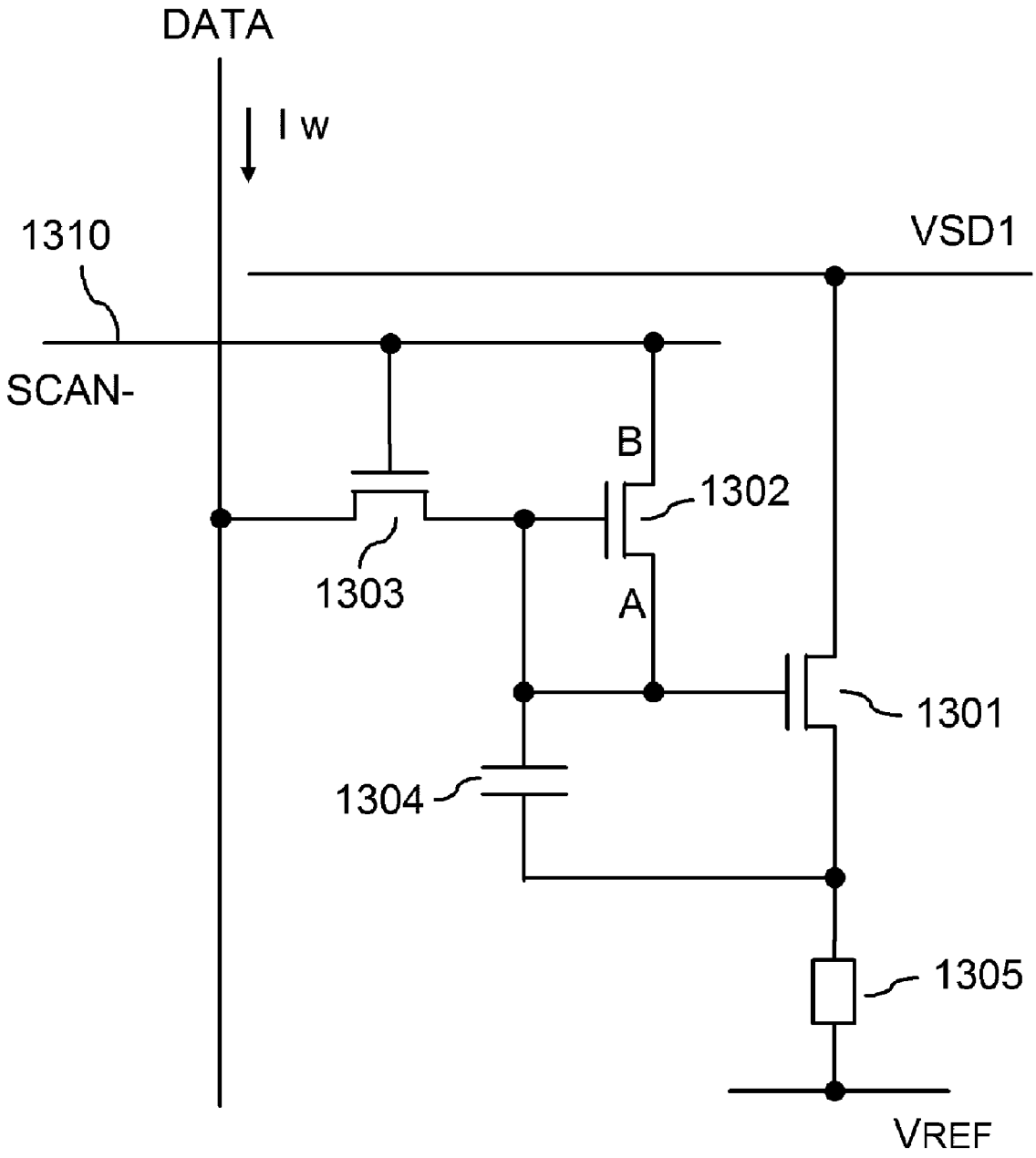
FIG. 13 is a schematic diagram of a pixel circuit in another embodiment of the present invention, wherein a switching voltage source is connected to the drive transistor.

The present invention is not restricted to using a merged scan-power electrode. The voltage source for delivering drive current may be separate from and switched simultaneous with the scan-power electrode. A variation from FIG. 8 thus provides another option for implementation. A preferred embodiment of this option is provided in FIG. 13, wherein a separate switching voltage source VSD1 is connected to the drive transistor 1301. In a preferred embodiment with n-channel drive transistor, FIG. 13 may be implemented with two n-channel transistors 1301 and 1302, a p-channel transistor 1303, a capacitor 1304, and a light emitting device 1305. The light emitting device may be a diode, or a bi-directional device. The operation and benefit of the present invention is not affected by the polarity of the light emitting device. The voltage levels of VSD1 may be similarly set as for a scan-power electrode, following the same consideration in the description above for FIG. 8. Slight deviation of the setting of voltage levels of VSD1 from that of the scan-power electrode is permissible in operation. This embodiment may provide slight benefit in lower electrode resistance for power electrodes VSD1, as wiring the power electrodes is more flexible than the scan-power electrodes.

Figure 14:
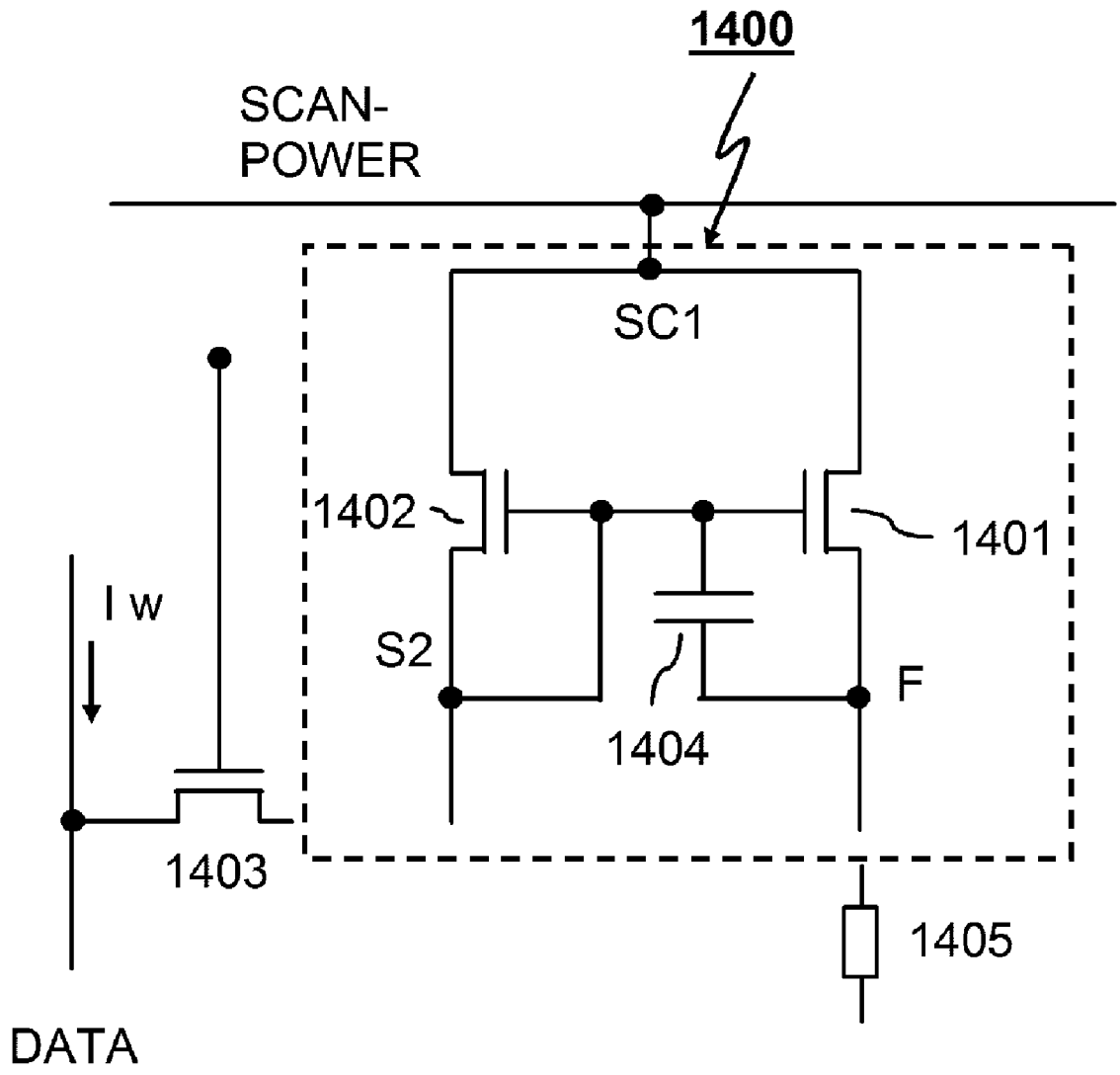
FIG. 14 is a schematic diagram of a preferred embodiment of a control circuit in a pixel of the present invention.

Furthermore, as illustrated in the preferred embodiments of FIGS. 8 and 10, the present invention provides a circuit element 1400 of FIG. 14 in a pixel, wherein 1400 comprises a first transistor 1401, a second transistor 1402, and a capacitor 1404. One (the first) end of capacitor 1404 is connected in common with the gate of transistor 1401, the gate of transistor 1402, and the second end S2 of transistor 1402; this common node S2 is referred to as the data input end. In preferred embodiments of FIGS. 8 and 10, this data input end is connected to the data electrode via a transistor 1403, as illustrate in the respective figures via the second and the third terminals of the transistor 1403. The other (second) end of capacitor 1404 is connected to a source-drain (a second) terminal of transistor 1401 at a node F, the drive output end. In a preferred embodiment, FIG. 8 for example, a light emitting element 1405 is connected to node F in common with the second end of 1404 and the second terminal of 1401. The third terminals of transistor 1401 and 1402 are connected in common at SC1, the pixel select end. In a preferred embodiment, FIG. 8 for example, the pixel selected end SC1 is connected to a scan electrode. In FIG. 14, the transistor 1401 corresponds to the transistors 801 and 1001 in the respective preferred embodiments of FIGS. 8 and 10; transistor 1402 corresponds to the transistors 802 and 1002 in the respective preferred embodiments of FIGS. 8 and 10. Circuit block 1400 is a re-orientation of corresponding circuit blocks in the respective embodiments in FIGS. 8 and 10.

Although various embodiments utilizing the principles of the present invention have herein been shown and described in detail, those skilled in the art can readily devise many other variances, modifications, and extensions that still incorporate the principles disclosed in the present invention. The scope of the present invention embraces all such variances, and shall not be construed as limited by the number of active elements, wiring options of such, or the polarity of a light emitting device therein.

What is claimed is:

1. A display comprising at least:

a data electrode;

a scanning electrode delivering at least a first and a second signals;

a reference voltage source;

a pixel connected to said data electrode, at least one said scanning electrode, and said reference voltage source;

said data electrode delivering data information to be displayed to said pixel;

said scan electrode selecting said pixel to receive said data information by carrying said first signal;

said pixel comprising at least:

a data setting transistor comprising a gate terminal, a second terminal and a third terminal;

a capacitor comprising a first end and a second end for holding a data voltage;

wherein said data setting transistor generates from said data information a data voltage at said first end of said capacitor during the period when said first signal is applied to said scan electrode;

wherein said scan electrode further sets the voltage of said second end of said capacitor to the same level as said scan electrode during the period when said first signal is applied to said scan electrode;

wherein said data setting transistor generates said data voltage from said data information; wherein said data information is a data current; wherein said data current is directed to flow in said data setting transistor via said second terminal and said third terminal of said data setting transistor.

2. The display according to claim 1, wherein said data setting transistor generates said data voltage at said gate of said data setting transistor, and at said first end of said capacitor.

3. The display according to claim 1, wherein said data setting transistor further generates said data voltage at said gate and at said second terminal of said data setting transistor.

4. The display according to claim 1, wherein said data setting transistor inhibits data current during the period when said second signal is applied to said scan electrode.

5. The display according to claim 1, wherein said pixel comprises in further detail at least:

a first transistor comprising a gate terminal, a second terminal and a third terminal;

a second transistor comprising a gate terminal, a second terminal and a third terminal;

wherein said second transistor is said data setting transistor;

wherein said scan electrode sets said second end of said capacitor to said first signal via a conducting path connecting said second end of said capacitor and said scan electrode via said first transistor during the period when said first signal is applied to said scan electrode.

6. The display according to claim 5, wherein said first transistor regulates a drive current directed to said first transistor according to said data voltage.

7. The display according to claim 5, wherein said pixel further comprises a light emitting element;

wherein said first transistor regulates a drive current directed to said light emitting element via said first transistor according to said data voltage.

8. The display according to claim 5, wherein said first end of said capacitor, the gate of said first transistor and the gate of said second transistor are connected together; wherein said second end of said second terminal of said first transistor are connected together; wherein said gate of said second transistor and said second terminal of said second transistor are connected; and wherein said third terminal of said first transistor and said third terminal of said second transistor are connected.

9. The display according to claim 8, wherein said pixel further comprises a light emitting element, wherein said light emitting element is connected to said second terminal of said first transistor.

10. The display according to claim 5, wherein said pixel further comprises:

a light emitting element, said light emitting element emits light according to a drive current directed thereto;

a third transistor comprising a gate terminal, a second terminal and a third terminal;

wherein said first transistor regulates a drive current directed to said light emitting element via said first transistor according to said data voltage;

wherein said third transistor is turned on by said scan electrode carrying said first signal, allowing a data current to enter said pixel;

wherein said data current is directed to said second (data setting) transistor; wherein said second transistor generates a data voltage at the gate of said second transistor according to said data current; said data voltage being directed at said first end of said capacitor, and at the gate of said first transistor.

11. The display according to claim 5 wherein said pixel further comprises:

a third transistor comprising a gate terminal, a second terminal and a third terminal;

wherein said pixel circuit is connected according to the followings:

said first end of said capacitor being connected to the gate of said first transistor, and to the gate of said second transistor;

said second end of said capacitor being connected to said second terminal of said first transistor;

said third transistor being connected between said data electrode and said first end of said capacitor, via said second terminal and said third terminal of said third transistor;

said third terminal of said second transistor being connected to said scan electrode.

12. The display according to claim 11, wherein said second terminal of said second transistor is connected to said first end of said capacitor.

13. The display according to claim 12, wherein said gate of said third transistor is connected to said scan electrode.

14. The display according to claim 12, wherein said gate of said third transistor is connected to said second terminal of said third transistor.

15. The display according to claim 11, wherein said third terminal of said first transistor is connected to said scan electrode.

16. The display according to claim 11, wherein said third terminal of said first transistor is connected to a drive voltage during a drive period, and connected to a voltage the same as the first signal during a scanning period.

17. The display according to claim 11, wherein said pixel further comprises a light emitting element, wherein said light emitting element is connected to said second terminal of said first transistor.

18. A display comprising at least:

a data electrode;

a scanning electrode delivering at least a first and a second signals;

a reference voltage source;

a pixel connected to said data electrode, at least one said scanning electrode, and said reference voltage source;

said data electrode delivering data information to be displayed to said pixel;

said scan electrode selecting said pixel to receive said data information by carrying said first signal during a scanning period;

said pixel comprising at least:

a conducting channel between said data electrode and said scan electrode;

a storage element comprising a first end and a second end for holding a data voltage; wherein said first end of said storage element is connected to a voltage node on said conducting channel;

a first transistor comprising a gate terminal, a second terminal and a third terminal;

wherein said conducting channel is enabled by said scan electrode carrying said first signal during a scan period, whereby conducts a data current directed from said data electrode to said scan electrode;

wherein said conducting channel generates from said data current a data voltage at said first end of said storage element during the period when said first signal is applied to said scan electrode;

wherein said conducting channel is disabled by said scan electrode carrying said second signal, inhibiting data current flow, whereby isolating said pixel from said data electrode;

wherein said second end of said storage element is set to the voltage of said scan electrode during the period when said first signal is applied to said scan electrode;

wherein said scan electrode sets the voltage of said second end of said storage element via said first transistor; wherein said first transistor connects said scan electrode and said second end of said storage element via said second terminal and said third terminal of said first transistor.

19. The display according to claim 18, wherein said conducting channel comprises a conversion element; said conversion element generates from said data current a data voltage at said voltage node.

20. The display according to claim 18, wherein said conducting channel comprises a data setting (second) transistor comprising a gate terminal, a second terminal and a third terminal; wherein said data setting transistor generates a data voltage from said data current, and wherein said gate of said data setting transistor is said voltage node.

21. The display according to claim 18, wherein said second end of said storage element is connected to said second terminal of said first transistor;

wherein said second terminal operates as a drain terminal of said first transistor during a scanning period when said first signal is applied to said scan electrode; wherein said second terminal operates as a source terminal during a drive period when said second signal is applied to said scan electrode.

22. The display according to claim 18 wherein said pixel further comprises a light emitting element;

wherein said first transistor is a drive transistor, regulating a drive current directed to said light emitting element via said first transistor according to said data voltage set on said storage element.

23. The display according to claim 22, wherein said drive current is directed from said scan-electrode via said first transistor.

24. The method for driving the display according claim 18 comprising the steps of:

applying said first signal to said scan electrode, enabling said conducting channel in selected pixels formatting data information in data current and delivering said data current via said data electrode;

allowing a data writing in selected pixel to set the storage element in said pixel to a generated data voltage;

applying a second signal inhibiting said conducting channel; maintaining said second signal to deliver a drive current to said light emitting element via scan electrode and said first transistor.

25. A display comprising:

a data electrode providing data input;

a pixel comprising:

a data setting circuit for converting a data in nut to a data voltage;

a storage element comprising a first end and a second end; said first end being connected to said data setting circuit to receive said data voltage, a transistor comprising a high impedance control terminal, a second terminal and a third terminal;

wherein said data setting circuit sets the data voltage to said storage element when a data input is converted to a data voltage;

wherein said second terminal of said transistor is connected to said second end of said storage element;

wherein said transistor further sets the voltage at said second end of said storage element the same as said third terminal of said transistor during the period when said data setting circuit sets a data voltage of the storage element;

wherein said data input is a data current directed via said data electrode to said data setting circuit, and wherein said data setting circuit converts said data current to a data voltage.

26. The display according to claim 25 wherein said data setting circuit conducts said data current.

27. The display according to claim 26, wherein said data setting circuit comprises a data setting transistor having a gate, a second terminal, and a third terminal;

wherein said data setting circuit converting said data current to a data voltage generates said data voltage at said gate of said data setting transistor.

28. A display comprising at least a pixel, said pixel comprising a control circuit having a data input end, a drive output end, and a pixel select end; wherein said control circuit further comprises:

a first transistor comprising a gate terminal, a second terminal, and a third terminal;

a second transistor comprising a gate terminal, a second terminal, and a third terminal;

a storage element having a first end and a second end;

wherein said gate of said first transistor, said gate of said second transistor, said second terminal of said second transistor, said first end of said storage element are connected in common with said data input end;

wherein said second end of said storage element, said second terminal of said first transistor are connected in common with said drive output end;

wherein said third terminals of said first transistor and said second transistor are connected in common with said pixel select end;

wherein said display further comprising:

a switching element having a gate, a second terminal, and a third terminal;

a data electrode for delivering data information to said pixel;

wherein said data electrode is connected to said data input end via said switching element; wherein said data input end is connected directly to said third terminal of said switching element; wherein said second transistor and said switching element are set to conducting state simultaneously by applying a control signal to said pixel select end.

29. The display according to claim 28 further comprising a scan electrode for selecting pixel for data input; said scan electrode being connected to said pixel select end; wherein said second transistor and said switching element are set to conducting state simultaneously by applying a control signal to said pixel select end via said scan electrode.

30. The display according to claim 29 further comprising a light emitting element comprising a first end and a second end; wherein said first end of said light emitting element is connected to said drive output end.

* * * * *